US007334445B2

(12) United States Patent
Speck

(10) Patent No.: US 7,334,445 B2
(45) Date of Patent: Feb. 26, 2008

(54) METHOD FOR PRODUCING AN END LUG OF A SPRING MEMBER FORMED OF A STRAND OF WIRE, AND APPARATUS FOR MANUFACTURING SAME

(75) Inventor: Norbert Speck, Reutlingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 283 days.

(21) Appl. No.: 11/083,414

(22) Filed: Mar. 18, 2005

(65) Prior Publication Data

US 2005/0204794 A1 Sep. 22, 2005

(30) Foreign Application Priority Data

Mar. 18, 2004 (EP) ..... 04006591

(51) Int. Cl.
*B21F 35/02* (2006.01)
*B21F 3/00* (2006.01)
*B21F 11/00* (2006.01)

(52) U.S. Cl. ..... 72/137; 140/103; 72/130

(58) Field of Classification Search ..... 72/135, 72/137, 140, 145, 130; 140/103
See application file for complete search history.

(56) References Cited

U.S. PATENT DOCUMENTS 2,843,159 A * 7/1958 Bonde et al. ..... 140/71 R
3,025,889 A * 3/1962 Clay ..... 140/71 R
3,405,742 A 10/1968 Guenther
3,672,410 A 6/1972 Scheckel
4,296,621 A * 10/1981 Ohdai et al. ..... 72/130
4,680,950 A * 7/1987 Ohdai et al. ..... 72/130
5,025,648 A * 6/1991 Matsuoka ..... 72/134
6,151,942 A 11/2000 Itaya

FOREIGN PATENT DOCUMENTS

| | | |
|---|---|---|
| FR | 2 415 497 | 8/1979 |
| JP | 56066535 | 6/1981 |
| JP | 58159132 | 9/1983 |

* cited by examiner

*Primary Examiner*—Derris H. Banks
*Assistant Examiner*—Teresa M Bonk
(74) *Attorney, Agent, or Firm*—Patterson, Thuente, Skaar & Christensen, P.A.

(57) ABSTRACT

A method and apparatus for producing an end lug of a spring member formed of a strand of wire, the strand of wire is initially gripped by two clamping jaws or a pair of tongs, held between said clamping jaws and, subsequently, at a predetermined distance behind the gripping tongs, while forming a rear wire segment protruding behind the spring element, is severed. In this regard, a shaping jaw conforming to the shape of the lug is employed as the one clamping jaw of the gripping tongs, around which the wire segment is bent by means of a shaping pin that can be inserted directly behind the other clamping jaw perpendicular to the longitudinal center line of the wire segment over the latter to form the lug. The relative movements between the shaping pin and the shaping jaw required for this purpose are generated by means of program-controlled movements of the gripping tongs and/or shaping pin.

3 Claims, 3 Drawing Sheets

METHOD FOR PRODUCING AN END LUG OF A SPRING MEMBER FORMED OF A STRAND OF WIRE, AND APPARATUS FOR MANUFACTURING SAME

FIELD OF THE INVENTION

The invention relates to the forming of end lugs on spring members formed from a strand of wire on a spring production machine.

BACKGROUND OF THE INVENTION

If springs in the form of tension springs must be used, it is necessary to provide them with lugs at both ends during production. Various lug forms are known, especially stem lugs (in which the lug sits on a stem progressing away from the spring element at a specific distance) as well as so-called "normal German lugs," in which the lug sits directly, and without formation of an intermediate stem, on the applicable end of the spring element. During production of the lugs, the shaping of the second, i.e., rear lug (at the end of the spring element) is especially problematic, particularly during the production of German lugs.

The production of a first (front) lug on the uncut wire directly in the spring production machine, such as a spring coiling machine, no longer presents a problem when a vertical mill is used and can be implemented easily. This, however, does not apply to the production of the second lug, namely the object at the end of the spring element; various methods have been used previously for its formation which.

The solution to the problem is relatively simple when such a lug is manufactured as a stem lug. In this case, the spring element is gripped and held by gripping tongs provided on the spring production machine and then severed from the wire by means of a cutting device. The excess wire segment is then, similar to the production of the first lug, shaped into a second (rear) lug by means of a vertical mill.

The production of a second (rear) German lug, however, is significantly more complex and requires additional equipment. In this case the spring, as described above, is initially provided with a first lug, which does not prove to be problematic in the case of the front lug, even when it is formed as a German lug. Then the spring element is shaped (e.g., coiled). However, only a short piece of wire would be necessary to form the second, that is, rear lug, which, however, a pair of gripping tongs would no longer be able to grip in such a way that a vertical mill could be used. For this reason, the spring element, which consists of a number of shaped coils and the first lug, has previously been gripped by a separate pair of gripping tongs to form a rear German lug, and has then been conveyed to another processing station known as a "lug plate," in which a second (German) lug could then be manufactured by setting up the last coil. However, a lug plate and a separate pair of gripping tongs are relatively costly additional devices and, furthermore, adjustment of a lug plate is rather complicated.

Based on the above, the goal of the invention is to find a method of the type mentioned initially, with which the production of the second (rear) lug, which may be one of a wide variety of lug types. In other words, also a German lug, can be creating using normal, standard tools, wherein operational safety is increased, and, as a whole, both the production process can be performed and the apparatus itself can also be manufactured more cost-effectively.

SUMMARY OF THE INVENTION

According to the invention, this goal is achieved with a method of the type mentioned initially, in that one of the clamping jaws of the gripping tongs is employed in the form of a shaping jaw conforming to the predetermined shape of the lug, around which the protruding rear wire segment is bent by means of a shaping pin moveable directly behind the other clamping jaw, perpendicular to the longitudinal direction of the rear wire segment, and over the latter to form the lug around the shaping jaw. Here the relative motion between the shaping pin and the shaping jaw required for this purpose is generated by means of program-controlled movements of the gripping tongs and/or shaping pin.

Thus, in the solution according to the invention, a pair of gripping tongs is used in which one of the two clamping jaws is formed as a shaping jaw, while the other serves as a bending pin for bending the lug into its shape. This makes it possible, in the method according to the invention, even when the wire segment at the end of the spring is too short and when a German lug is to be formed there, to be able nonetheless to grip said wire segment with the gripping tongs formed in accordance with the invention. This is because during the subsequent bending of the rear wire segment around the shaping jaw of the gripping tongs, separate, additional space is required to allow the gripping tongs to grip outside the bent lug shape on the side toward which bending takes place is no longer necessary.

The method according to the invention now makes this possible, so that both stem lugs and normal German lugs, as well as other lugs, can be manufactured using one set of standard tools without encountering any problems whatsoever. A separate, additional processing station in the form of a lug plate is no longer necessary on the machine; In addition, the additional gripping tongs previously required for conveyance to the lug plate can also be fully eliminated.

The method according to the invention allows for a highly precise production of the rear lugs manufactured therewith, even in the case of German lugs, thereby increasing the operational safety of the production process for such tension springs. Moreover, the method of the invention allows for the production of lugs in a shorter period of time than can be achieved using conventional methods, due to the intermediate steps required in said methods. Thus, the production method according to the invention also proves, in general, to be especially cost-effective.

Thus, the method according to the invention offers significant simplification and improvement over the method known in the art for the shaping of such rear lugs, especially German lugs.

The method according to the invention can be performed in an especially advantageous manner in that the movements of the gripping tongs during the shaping of the lug only take place parallel to a direction of motion, which is very especially preferably perpendicular to the longitudinal direction of the rear wire segment.

In the method according to the invention, the movement of the shaping pin during the production of the lug is advantageously achieved in that said pin is moved in a direction perpendicular to the longitudinal direction of the wire segment and, additionally, along a circular path.

If the method according to the invention is to be used to manufacture a German lug, the rear wire segment is gripped and held directly behind the spring element by the clamping jaws of the gripping tongs, after which the lug is shaped in the manner described.

An especially advantageous embodiment of the spring production method of the invention is achieved in that, prior to shaping of the rear lug, the spring element, together with the front lug already molded to it and the rear wire segment, are moved, by means of the gripping tongs, out of the spring coiling space of the spring production machine. As a result, the next spring element with a front lug can be manufactured while the machine is shaping the rear lug, thereby substantially increasing the operating efficiency of the machine.

In the method according to the invention, it is especially preferable to bend the lug around the shaping jaw to the side of the wire segment toward which the spring element is shaped.

The goal mentioned further above is achieved, with respect to the apparatus mentioned initially, in that one of the jaws of the gripping tongs is shaped in the form of a shaping jaw corresponding to the shape of the lug and, further, a shaping pin retractable on the side of the other clamping jaw, directly behind said jaw as well as above the wire segment, perpendicular to its longitudinal axis, is provided, by means of which the rear wire segment can be bent around the shaping jaw of the gripping tongs to form the lug, wherein the gripping tongs and/or the shaping pin sit on moveable carrying devices and a program control is provided with which the movement(s) of the carrying device(s) to perform the relative movement(s) between the shaping pin and the shaping jaw required to shape a lug is/are controllable.

The apparatus according to the invention is suitable for performing the method according to the invention, and features a significantly simplified structure in comparison to previously known devices, because neither a lug plate nor a second pair of gripping tongs are necessary, for which reason it can also be manufactured more cost effectively than previously known apparatuses for the same purpose. Furthermore, the measures employed in accordance with the invention, especially the forming of one of the clamping jaws of the gripping tongs as a shaping jaw (in the sense of a bending pin), can be executed without significant cost.

The apparatus according to the invention is preferably formed in such a way that the movement devices for the gripping tongs comprise a vertically moveable supporting table, on which said tongs are placed, as well as a device for moving the gripping tongs perpendicular to the longitudinal direction of the protruding strand of wire (or, which is equally applicable, the supplied strand of wire). An especially uncomplicated embodiment of the apparatus according to the invention is achieved as a result.

Advantageously, in the apparatus according to the invention, of the two clamping jaws of the gripping tongs, the one that is formed as the shaping jaw is that which, upon gripping the wire segment, lies on the side of said wire segment toward which the spring element is molded onto said wire segment.

In the apparatus according to the invention, it is also advantageous if the movement devices for the shaping pin also comprise a vertically moveable supporting table and a device for moving the shaping pin perpendicular to the longitudinal direction of the supplied strand of wire. In this case, the shaping pin also sits on a vertical mill mounted on the supporting table, by means of which it can also be moved in a circular motion, which is particularly preferable. Thus, all relative movements between the shaping jaw and the shaping pin required for the formation of the rear lug are easily achieved with simple, easily controllable means.

In the following, the invention is explained in greater detail on the basis of the drawing, in schematic and in exemplary form.

DETAILED DESCRIPTION OF THE INVENTION

Figure 1:
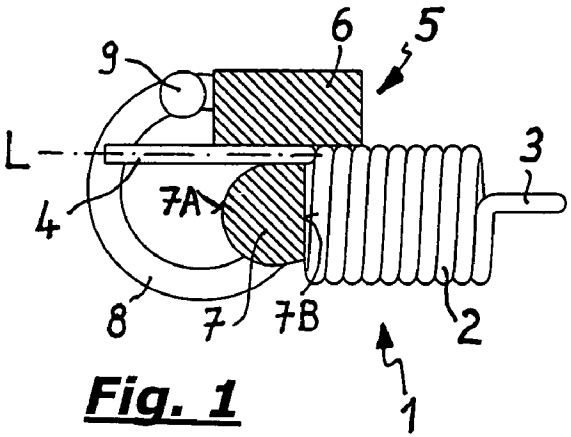
FIGS. 1 to 5 show schematic depictions of the individual steps in a method according to the invention required to manufacture a German lug.
Figure 2:
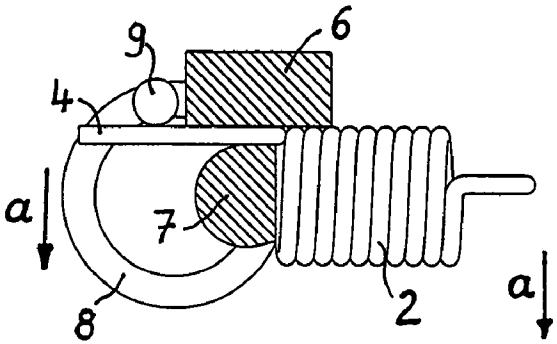

In the following description relating to the depictions of the individual figures, identical parts are consistently identified with the same reference symbols.

In FIGS. 1 to 5, the completion of the individual steps for forming a "German lug" is initially shown in an enlarged depiction.

The figures initially show a spring 1, which consists of a spring element 2 previously formed on a spring coiling machine (not shown), the front end of which is provided with a front lug 3, which is also already formed. At its rear (located to the left in the figures) end, which faces the wire feed, a rear wire segment 4 protrudes from the spring element 2, said wire segment already having been severed from the supplied strand of wire in a preceding step.

As the figures show, the spring 1 is gripped at the rear wire segment 4 by a pair of gripping tongs 5 directly behind the spring element 2, said gripping tongs having two (shown in a schematic sectional view in the figures) clamping jaws 6 and 7 that clamp the rear wire segment 4 in the manner shown. In this regard, the clamping jaw 6 shown at the top in the figures is designed to be somewhat wider than the other clamping jaw 7, its side facing the spring 1 resting on the upper side of the spring element 2 and, at the top, on the wire segment 4 protruding at the rear, so that, on the whole, a predetermined orientation of the spring 1 in the gripping tongs 5 can be achieved.

Figure 5:
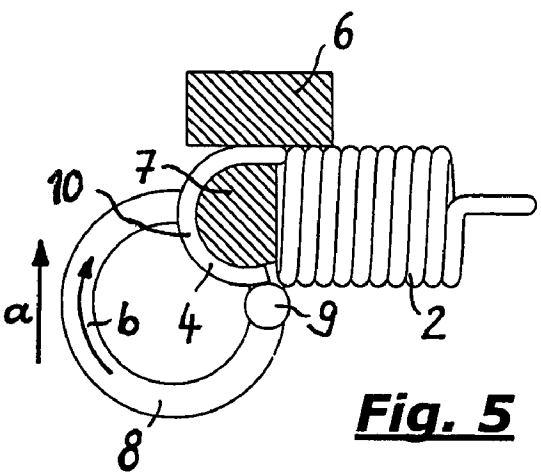

The other clamping jaw is formed in the shape of a shaping jaw 7 corresponding to the desired lug shape, said shaping jaw serving as a bending pin to form the rear lug 10 (see FIG. 5). It is disposed on the side of the rear wire segment 4, toward which the spring element 2 was shaped, i.e., on the side, beginning at the rear wire segment 4, toward which the spring coils of the spring element 2 are formed (in FIGS. 1 to 5: downward), so that the shaping jaw 7, for its part, also laterally supports the spring element 2, as depicted in FIGS. 1 to 5. This bending pin has a cross-section of suitable form, by means of which it, on the one hand, ensures an orientation of the last coil of the spring element 2 (and thus of the last coil as a whole) toward the rear wire segment 4, even during bending of the rear lug 10. At the same time, it also predetermines the bending shape for the desired shape of the lug 10. This shape is achieved, in the depictions of FIGS. 1 to 5, with a form of the shaping jaw 7, which, on its surface 7A oriented toward the rear (that is, toward the left in the figures), is shaped to correspond to the desired lug shape and, on its side facing the spring element 2, has a locating face 7B in the form of a flat support surface.

As is evident in FIG. 1, directly behind the gripping tongs 5, above the wire segment 4 protruding at the rear and directly behind the upper clamping jaw 6 as well as perpendicular to the longitudinal axis L of the wire segment 4, a shaping pin 9 has been moved from a position behind the plane of the drawings in FIGS. 1 to 5 into the position, shown in FIG. 1 (in the plane of the drawing). Here it lies above the wire segment 4. The shaping pin 9 itself sits on a vertical mill 8, by means of which it can be moved in a circular path (naturally in both directions of same) and which, for its part, can be moved perpendicular to the central longitudinal axis L of the rear wire segment 4, as is indicated by the arrow a in FIG. 2 to 5.

Figure 3:
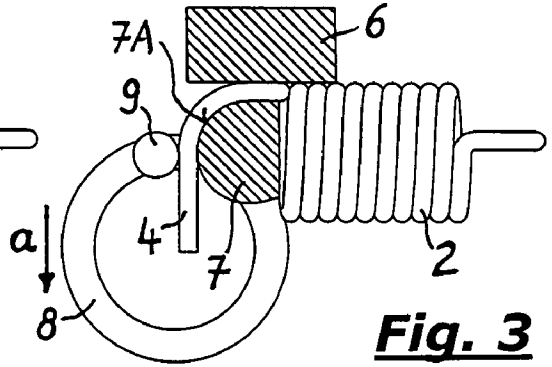
Figure 4:
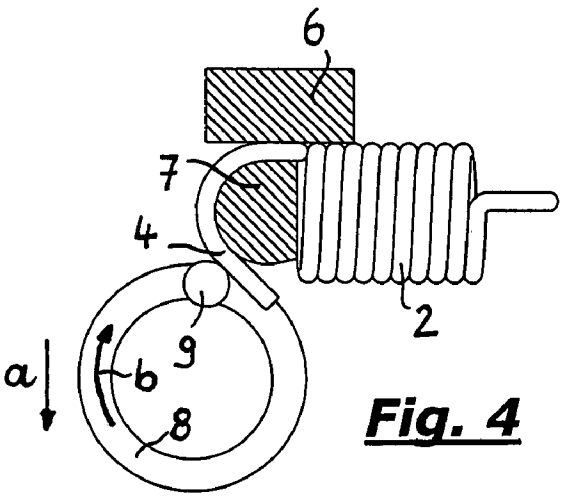

Once the shaping pin 9 has been moved into the position shown in FIG. 1, it is subsequently (see FIG. 2) lowered perpendicular to the rear wire segment 4 in direction a, until it rests against the top of the rear wire segment 4. As shown in FIG. 3, however, the lowering motion is continued further, which results in the rear wire segment 4 being bent over the upper, curved part of the shaped segment 7A of the shaping jaw 7. As soon as the position shown in FIG. 3 is reached, that is, the position in which the shaping jaw 9 has reached the point of the lug 10 to be shaped that protrudes the farthest from the spring element 2 (FIG. 5), it is subsequently, as can be inferred from FIG. 4, rotated somewhat farther in direction a and, additionally, along a circular path through the vertical mill 8 in the direction of arrow b, which results in it bringing about the shaping of the lug 10, also in the shaping segment, now oriented toward the right, of the shaping jaw 7 serving as a bending pin. At the appropriate time, the vertical mill 8 is then moved somewhat upward in the opposite direction, that is, in the direction of arrow a shown in FIG. 5, wherein the rotational movement of the vertical mill 8 is somewhat retained. In this manner, as is evident in FIG. 5, shaping of the lug 10 in the form of a "German lug" at the end of the spring element 2 can be completed.

During the entire bending process for the lug 10, the spring element 2 rests against the support surface 7B of the shaping jaw 7, on the side facing it, wherein the shaping jaw 7 simultaneously acts as a counter-support during the bending of the lug 10.

Once the lug 10 has been bent at the rear end of the spring 1, the gripping tongs 5 can be opened and the spring 1 released, at which point the gripping tongs 5 can grip a new spring 1.

In the situation shown in FIG. 1, a few processing steps have already been performed on a spring production machine. Thus, for example, the first lug 3 was already bent by means of a vertical mill and then set up, and the spring element 2 was subsequently coiled. Then the rear protruding wire segment 4 was severed, by means of the gripping tongs 5 and their jaws 6 and 7, from the strand of wire supplied from a wire reservoir, wherein the spring 1 remains held in place by the gripping tongs 5.

In the position then reached, the lug can, of course, then be formed into the shape described previously herein.

It is also possible, however, following the separation of the wire segment 4 from the supplied strand of wire by means of the gripping tongs 5, initially to move the springs 1 shaped to this point from the spring coiling space of the machine. This is only to complete the forming of the lug 10 in a different position, so that said forming can be done parallel to and independently of actual spring production. In the interim, the next spring element 1 with front lug 3 molded to it can be manufactured in the spring coiling space while lug 10 is being formed.

Figure 6:
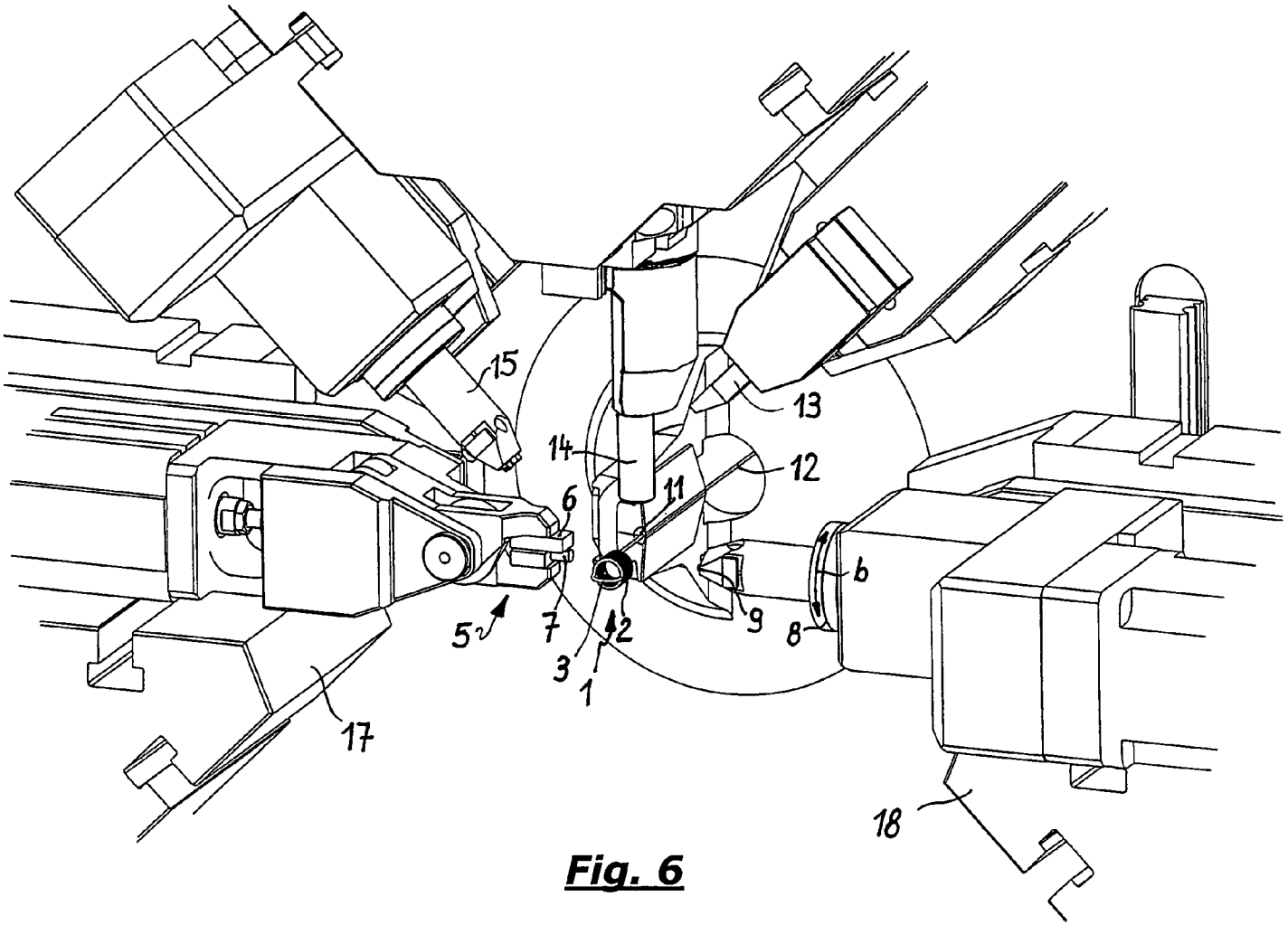
FIG. 6 and FIG. 7 show schematic, perspective depictions on the spring shaping area in an apparatus according to the invention, in which a spring element having a front lug already molded to it still sits on the strand of wire from the wire feed device.
Figure 7:
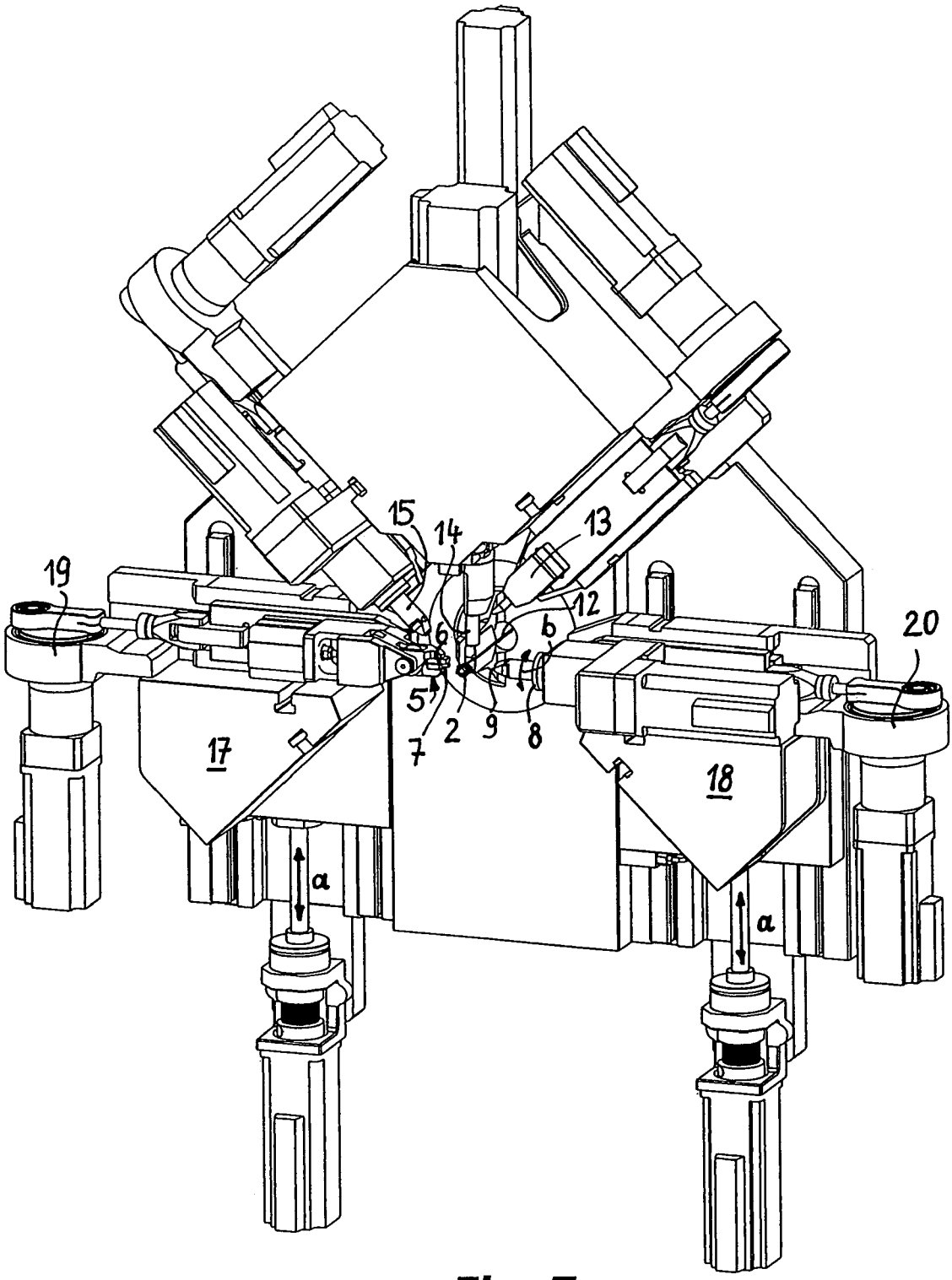

Finally, FIG. 6 shows, in a schematic, perspective depiction, a segment of a spring coiling machine, namely a view of the spring coiling space, while FIG. 7 shows a larger section of this spring coiling machine (in perspective), which also depicts the vertically moveable tables for moving the gripping tongs in and out and the vertical mill used in lug production.

FIGS. 6 and 7 depict a situation in which a spring element 2 has been produced with a front lug 3 already molded to it and set up, said spring element also being located at the end of the strand of wire 12 fed through a wire feed 11.

A cutting device 13, a shaping tool 14, as well as a vertical mill 15 have been moved out of the coiling space for the already coiled spring element 2.

From FIG. 7, it can be inferred that a pair of gripping tongs 5 and another vertical mill 8, respectively, are arranged on a vertically moveable support table 17 or 18, specifically in such a way that, in a position moved upward, they can each be moved toward or away from the already manufactured spring 1 by means of an internal drive 19 or 20 in a [word apparently missing] perpendicular to the direction of motion a of the vertically moveable table (and, at the same time, also perpendicular to the wire feed direction of the strand of wire 12).

As is clearly inferable from FIG. 6, the shaping pin 9 sits at the end of a tool facing the spring element 2, said tool being mounted on the vertical mill 8 and by means of which rotation in rotational direction b can be effected. Because the shaping pin 9 is not mounted on the axis of rotation, but instead is mounted on the vertical mill 8 at a distance from said axis of rotation, a rotation in rotational direction b results in the shaping pin 9 being moveable along a circular path b (and in both directions of same) corresponding to a radius corresponding to its distance from the axis of rotation of the vertical mill 8.

The depictions in FIGS. 6 and 7, especially the somewhat enlarged depiction in FIG. 6, clearly show the gripping tongs 5 with the two clamping jaws, namely the upper clamping jaw 6 and the lower clamping jaw, which is formed as a shaping jaw 7. FIGS. 6 and 7 show the gripping tongs 5 as well as the shaping pin 9 in a position in which they have not yet been moved into place.

Then, to complete the production of the desired spring 1, the gripping tongs 5 are first moved out of the position shown in FIGS. 6 and 7 and in the direction of the strand of wire 12 exiting the wire feed 11, where they grip said strand of wire directly behind the spring element 3. Then the cutting tool 13 moves into place and severs the strand of wire exiting the wire feed 11, thereby forming the rear wire segment 4 behind the spring element 2. Then the gripping device 5, by means of the movement devices acting upon it and through lowering of the table 17 supporting it and the spring 1, which holds it, moves downward (in direction a) out of the spring coiling area of the apparatus shown in the figures; likewise, the vertical mill 8 and lathe tool 8, which holds the shaping pin 9, is lowered vertically downward (in direction a) through the table 18 holding it, after which, in the lower terminal position, the tools 5 and 9 lying opposite one another relative to the rear wire segment 4 complete the manufacturing steps shown in FIGS. 1 to 5 to shape the rear lug 10.

Meanwhile, a new spring element 2 with a front lug 3 could already be formed in the upper spring coiling area. By means of suitable coordination of the steps performed, it is possible to ensure that once the forming of the spring shown in FIGS. 6 and 7 has been completed, the molding of the lug 10 to the previously manufactured spring element 2 outside the spring coiling space is completed, the finished spring 1 is released by the gripping tongs 5, and the gripping tongs 5 as well as shaping pin 10 are returned to their retracted position, as it is shown in FIG. 7.

To form the lug 10, the movements of the gripping tongs 5 and the shaping pin 9 across the drives 19, 20 and the vertically moveable tables 17, 18 are generally controlled by a program control (not shown in the figure).

Naturally, the method and apparatus described can, in principle, also be used to manufacture lugs curved on the exterior, that is, on the side opposite the spring element 2 relative to the wire segment 4. To this end, it is only necessary to use the gripping tongs 5 in such a way that their shaping jaw 7 lies on the side opposite the side of the wire segment 4 shown in the figures, as well as to modify the program control accordingly.

The invention claimed is:

1. A method of forming an end lug on a spring member formed of a strand of wire on a spring production machine, following the shaping of the spring member, comprising the steps of:

gripping the strand of wire continuing from said spring member between two clamping jaws of a pair of gripping tongs;

holding the strand of wire in place between said clamping jaws;

subsequently, severing the strand of wire at a predetermined distance from the gripping tongs, thus forming a rear wire segment protruding behind the spring element;

wherein one of the two clamping jaws of the gripping tongs comprises a shaping jaw conforming to the shape of the lug, around which the wire segment is bent by a forming pin, which is inserted perpendicular to a longitudinal axis of a wire segment behind the other clamping jaw above the wire segment to form the lug;

wherein relative motion between the forming pin and the shaping jaw is generated by program-controlled movements of the gripping tongs, the forming pin or both; and wherein movement of the gripping tongs during shaping of the lug only takes place in parallel to a direction of motion perpendicular to the longitudinal axis of the wire segment.

2. A method of forming an end lug on a spring member formed of a strand of wire on a spring production machine, following the shaping of the spring member, comprising the steps of:

gripping the strand of wire continuing from said spring member between two clamping jaws of a pair of gripping tongs;

holding the strand of wire in place between said clamping jaws;

subsequently, severing the strand of wire at a predetermined distance from the gripping tongs, thus forming a rear wire segment protruding behind the spring element;

wherein one of the two clamping jaws of the gripping tongs comprises a shaping jaw conforming to the shape of the lug, around which the wire segment is bent by a forming pin, which is inserted perpendicular to a longitudinal axis of a wire segment behind the other clamping jaw above the wire segment to form the lug;

wherein relative motion between the forming pin and the shaping jaw is generated by program-controlled movements of the gripping tongs, the forming pin or both; and wherein during production of the lug the forming pin performs movements that progress in a direction perpendicular to the longitudinal axis of the wire segment and, additionally, in a circular path.

3. A method of forming an end lug on a spring member formed of a strand of wire on a spring production machine, following the shaping of the spring member, comprising the steps of:

gripping the strand of wire continuing from said spring member between two clamping jaws of a pair of gripping tongs;

holding the strand of wire in place between said clamping jaws;

subsequently, severing the strand of wire at a predetermined distance from the gripping tongs, thus forming a rear wire segment protruding behind the spring element;

wherein one of the two clamping jaws of the gripping tongs comprises a shaping jaw conforming to the shape of the lug, around which the wire segment is bent by a forming pin, which is inserted perpendicular to a longitudinal axis of a wire segment behind the other clamping jaw above the wire segment to form the lug;

wherein relative motion between the forming pin and the shaping jaw is generated by program-controlled movements of the gripping tongs, the forming pin or both; and prior to production of the end lug, moving the gripping tongs holding the spring member together with a front lug already molded to it and the wire segment, out of a spring coiling space of the spring production machine.

* * * * *